United States Patent [19]

Kobayashi

[11] Patent Number: 4,773,464

[45] Date of Patent: Sep. 27, 1988

[54] ACTUATOR FOR ELECTRIC BLINDS

[75] Inventor: Masanori Kobayashi, Niigata, Japan

[73] Assignee: Kuron Corporation, Japan

[21] Appl. No.: 29,327

[22] Filed: Mar. 23, 1987

[30] Foreign Application Priority Data

Sep. 22, 1986 [JP] Japan ..... 61-224287
Sep. 22, 1986 [JP] Japan ..... 61-145498[U]

[51] Int. Cl.[4] ..... E06B 9/36

[52] U.S. Cl. ..... 160/168.1; 160/176.1; 160/900

[58] Field of Search ..... 160/166 A, 168 R, 174, 160/176 R, 177, 178 R, 173, 172, DIG. 17

[56] References Cited

U.S. PATENT DOCUMENTS

| | | | |
|---|---|---|---|
| 3,134,428 | 5/1964 | Kehrer et al. | 160/172 |
| 3,190,346 | 6/1965 | Arena et al. | 160/172 |
| 3,455,364 | 7/1969 | Fukuoka | 160/172 |
| 3,463,219 | 8/1969 | Osterholz | 160/172 |
| 3,468,360 | 9/1969 | Payne | 160/176 X |
| 3,500,896 | 3/1970 | Endou | 160/168 R |
| 3,789,905 | 2/1974 | Saito | 160/168 R |
| 4,096,903 | 6/1978 | Ringle | 160/176 R |

FOREIGN PATENT DOCUMENTS 2161117 6/1973 Fed. Rep. of Germany ... 160/168 R

*Primary Examiner*—Ramon S. Britts
*Assistant Examiner*—David M. Purol
*Attorney, Agent, or Firm*—Steele, Gould & Fried

[57] ABSTRACT

Herein disclosed is an actuator for actuating an vertical blind or curtain of electric type to be mounted on a mounting support face. The actuator is enabled to eliminate the deformations such as torsions of rotating rods thereto to ensure their rotations by driving the two ends of each of the rotating rods with the torques of a pair of motors. The tension to be applied to a traverse rod can be easily adjusted to an appropriate value by fastening a nut on a tensing threaded rod connected to the traverse rod to tense the traverse rod. Rotation transmitting unit can be held in position in a pivotal state even if the tension is applied to the traverse rod. Since the traverse rod is fitted in a bearing by the face contact between ridges and corners, moreover, the rotating torque is dispersed to enhance the breaking stress at the fitted connection.

17 Claims, 7 Drawing Sheets

ACTUATOR FOR ELECTRIC BLINDS

BACKGROUND OF THE INVENTION

1. Field of the Invention

The present invention relates to an electric blind of vertical type and, more particularly, to an actuator for driving rotating rods borne in the casing frame of the electric blind (which may be either a vertical blind or curtain of electric type) with respective electric motors.

2. Description of the Prior Art

Representatives of the vertical blind according to the prior art are disclosed in U.S. Pat. Nos. 4,306,608 4,262,728 and 4,261,408, for example.

In these vertical blinds, generally speaking, two traverse and tilt rods for traversing and tilting slats are rotatably borne in the casing frame in juxtaposition to each other such that the traverse rod is rotated by its drive motor to traverse a plurality of runners reciprocally in the casing frame and such that the tilt rod is rotated by its drive motor to tilt the slats reciprocally, each of which is suspended from the corresponding one of the runners.

Incidentally, in the vertical blind of electric type, the traverse rod and the tilt rod are borne in the casing frame in parallel with each other such that the traverse rod has its one end connected through a drive transmission to its drive motor and such that the tilt rod has its other end connected through a drive transmission to its drive motor. Thus, in some actuator for actuating the vertical blind of the prior art, each of the rotating rods, i.e., the traverse rod or the tilt rod is given the driving force of the corresponding one of the motors at its one end.

In the prior art described above, either in case the slats suspended from the hooks of the runners are heavy or in case the rotating rods are long, the rotating rods require accordingly increased forces so that large-sized motors have to be mounted in the casing frame. As a result, the casing frame per se has to be enlarged in size, thus raising a problem that it is large-sized to have a rather ugly appearance.

Since a driving force is applied to one end of each rotating rod, moreover, in case the heavy slats are suspended, there arise a problem that a torsion is generated to twist the rotating rods or that the driving force fails to be completely transmitted to the other end of each rotating rod.

In the vertical blind, still moreover, the traverse rod and the tilt rod carry such supports as will be reciprocated by the rotations of the traverse rod so that the gap between the two rods and the gap between the two rods and the casing frame may be held constant to prevent the traverse rod from running out. For this purpose, the plural supports are reciprocated by the rotations of the traverse rod to keep the rod steady. As the vertical blind becomes the larger, the load to be applied to the runners becomes the higher to raise another problem that the traverse rod cannot be kept steady, varying from support to support.

SUMMARY OF THE INVENTION

It is, therefore, a first object of the present invention to provide an actuator for a vertical blind of electric type, which can eliminate the deformations such as torsions of rotating rods to ensure their rotations.

A second object of the present invention is to provide an actuator of the above type, which can easily adjust the tension to be applied to a traverse rod to an appropriate value.

A third object of the present invention is to provide an actuator of the above type, which can prevent rotation transmitting means from being displaced even if the tension is applied to the traverse rod.

A fourth object of the present invention is to provide an actuator of the above type, which has such bearings for the traverse rod as are enabled to endure a high torque by dispersing it.

In an electric blind to be mounted on a mounting support face, comprising: a generally elongatetd casing frame having a pair of longitudinally extending guide rails; relatively long rotating rod means borne rotatably in the longitudinal direction of said casing frame; a plurality of runners made rotatable to run one after another on said guide rails when said rotating rod means is driven; and a plurality of slats each suspended from the corresponding one of said runners, according to a major feature of the present invention, there is provided an actuator for actuating said electric blind, comprising: at least one pair of drive means disposed at two end portions of said casing frame for driving the two ends of said rotating rod means in a manner to eliminate any deformation of said rotating rod means; drive transmission means for transmitting therethrough the driving forces of said drive means to said rotating rod means; and bearing means for bearing said rotating rod means.

BRIEF DESCRIPTION OF THE DRAWINGS

Other objects, features and advantages of the present invention will become apparent from the following description to be made with reference to the accompanying drawings In FIGS. 1 to 7 showing a first embodiment of the present invention:

FIG. 11 is a partially cut-away top plan view showing a traverse rod tensing mechanism;

FIG. 12 is an exploded perspective view showing the tensing mechanism of FIG. 11;

FIG. 13 is a transverse section taken along line E—E of FIG. 11;

FIG. 14 is a traverse section taken along line F-F of FIG. 11;

FIG. 15 is a longitudinal vertical section showing an essential portion of the traverse rod tensing mechanism of FIGS. 11 to 14;

FIG. 16 is a partially cut-away top plan view showing a modification of the traverse rod tensing mechanism; and FIG. 17 is a schematic diagram for explaining the actions of the traverse rod tensing mechanisms of FIGS. 15 and 16.

FIG. 18 is a longitudinal section showing a fitting structure for fitting a rotation transmitting mechanism;

FIG. 19 is a perspective view showing the fitting structure of FIG. 18;

FIG. 20 is a longitudinal section showing the fitting structure of FIGS. 18 and 19;

FIG. 21 is a section taken along line G—G of FIG. 20 but shows a modification of the fitting structure; and FIG. 22 is similar to FIG. 21 but shows another modification of the fitting structure.

FIG. 23 is an exploded perspective view showing the bearing unit;

FIG. 24 is a longitudinal vertical section showing an essential portion of the bearing unit; and FIG. 25 is an exploded perspective view showing the essential portion of FIG. 24.

DESCRIPTION OF THE PREFERRED EMBODIMENTS

The present invention will be described in the following in connection with the embodiments thereof with reference to the accompanying drawings.

Figure 1:
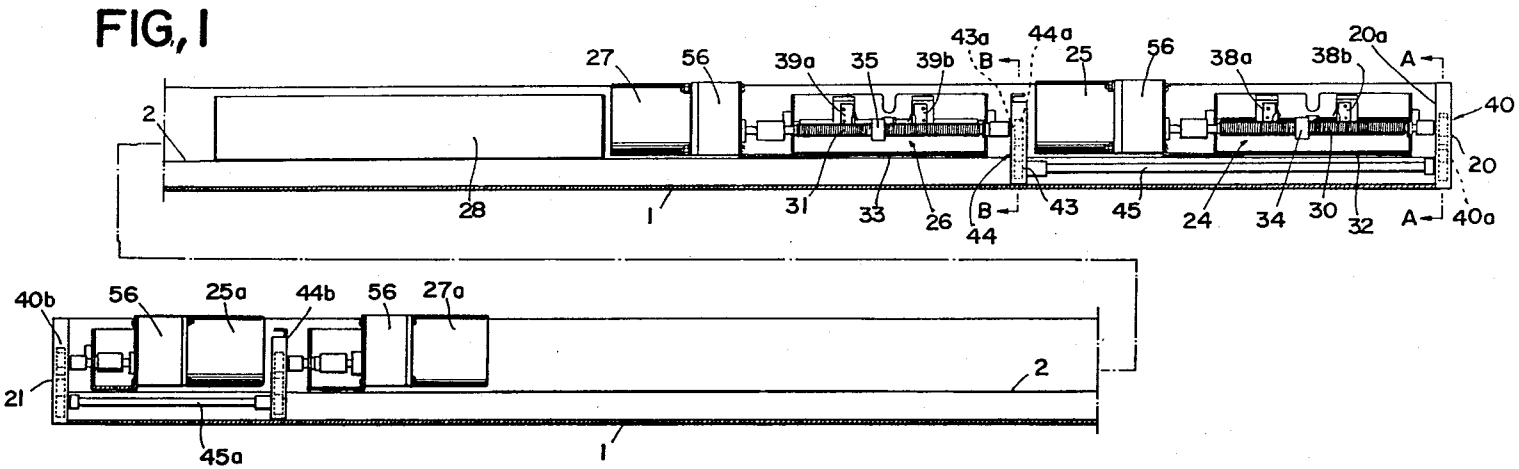
FIG. 1 is a top plan view showing the overall structure of a vertical blind of electric type incorporating an actuator according to the present invention.
Figure 2:
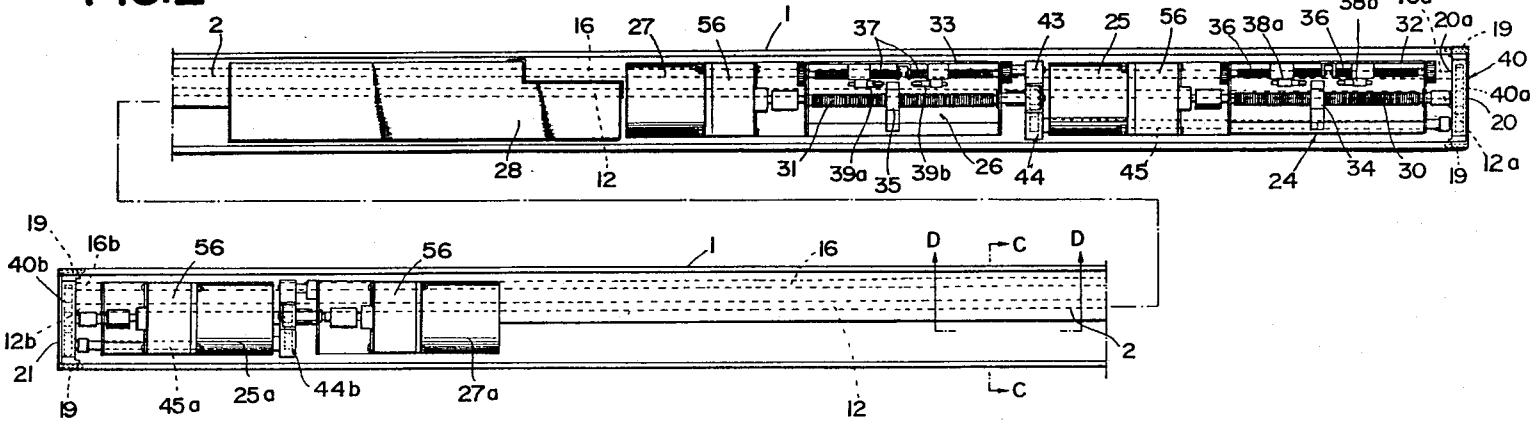
FIG. 2 is a longitudinal vertical section showing the overall structure of FIG. 1.
Figure 3:
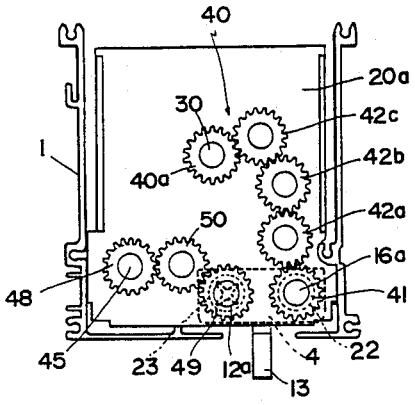
FIG. 3 is an enlarged transverse section taken along line A—A of FIG. 1.
Figure 4:
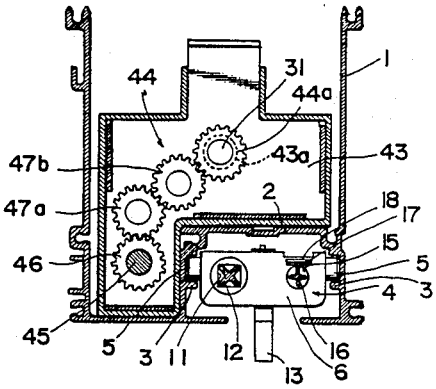
FIG. 4 is an enlarged transverse section taken along B—B of FIG. 1.
Figure 5:
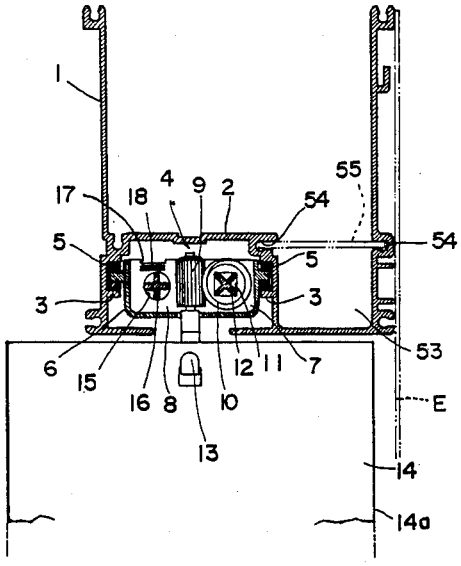
FIG. 5 is an enlarged transverse section taken along line C—C of FIG. 2.
Figure 6:
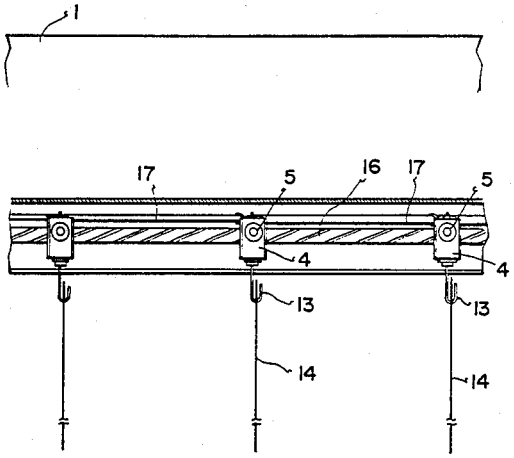
FIG. 6 is an enlarged logitudinal verticla section taken along line D—D of FIG. 2.

In FIGS. 1 to 7, reference numeral 1 generally denotes a casing frame which is made of an aluminum alloy or the like and has a generally square section opened upward. This casing frame 1 is suspended from a support such as the upper frame of a window or a ceiling by means of not-shown mounting brackets. Denoted at numeral 2 is a rod chamber which is defined to extend at one side in the lower portion and along the whole length of the casing frame 1. At the two side walls of the rod chamber 2, there are formed a pair of guide rails 3 which are opposed to each other. In each of the guide rails 3, there are fitted a plurality of pairs of rollers 5, the paired ones of which are pivotally borne at the two ends of each runner 4, such that they can run on the guide rails 3. As shown in FIGS. 4 and 5, the runner 4 is constructed of a casing 6 which is made of a synthetic resin or the like in a flattened shape. This casing 6 is divided into two compartments 7 and 8, and a worm shaft 9 is rotatably fitted upright in the center of the casing 6 between the two compartments 7 and 8. This worm shaft 9 is in meshing engagement with a worm gear 10 which is rotatably borne in the compartment 7. This worm gear 10 is formed on its axis with a square-shaped fitting bore 11 to which is keyed in a meshing and slidable engagement a tilt rod 12 having a cross section. Denoted at numeral 13 is a hook which is connected to the lower end of the worm shaft 9 and from which is suspended a slat 14. This slat 14 is offset from the center line of the casing frame 1 such that its edge portion 14*a* is positioned inside of the perpendicular E of the end portion of the casing frame 1.

On the other hand, the other compartment 8 of the casing 6 of the runner 4 does not accommodate anything therein but is formed on its center line with a circular bore 15 in which is slidably and loosely fitted a traverse rod 16 having the construction of a screw shaft. The compartment 8 is further formed in its side wall with an opening 18 in which is fitted a spacer 17. On the other hand, the not-shown leading one of the runners 4 has its compartment 8 formed in its side wall with a circular hole in which is slidably and loosely fitted the traverse rod 16. The other wall of the compartment 8 is formed with a cross-shaped fitting hole to which is keyed the traverse rod 16. Moreover, the leading runner is preceded by a not-shown steady support.

In the rod chamber 2 formed at one side of the lower portion of the casing frame 1, there are arranged in parallel the aforementioned traverse rod 16 and tilt rod 12 which are pivotally borne by means of bearings 22 and 23 in side plates 20 and 21 which in turn are fastened to the two ends of the casing frame 1 by screws 19.

At one end portion of the casing frame 1 and over the rod chamber 2, there are accommodated sequentially in the recited order a traverse controller 24 of the traverse rod 16, a first traverse drive motor 25, a tilt controller 26 of the tilt rod 12, a first tilt drive motor 27, and a control box 28 for accommodating a not-shown electric circuit or the like therein.

Within the traverse and tilt controllers 24 and 26, respectively, there are borne in limit boxes 32 and 33 threaded rods 30 and 31 which are connected to the respective output shafts of the drive motors 25 and 27. Transverse and tilt control members 34 and 35 are movably screwed on those threaded rods 30 and 31. On threaded rods 36 and 37 which are borne in parallel with the threaded rods 30 and 31, respectively, there are movably carried microswitches 38*a* and 38*b*, and 39*a* and 39*b*, the paired ones of which are positioned across the aforementioned traverse and tilt control members 34 and 35, respectively. As the threaded rods 30 and 31 are rotated by the driving forces of the first traverse drive motor 25 and a later-described second traverse drive motor 25*a*, and the first tilt drive motor 27 and a later-described second tilt drive motor 27*a*, the traverse and tilt control members 34 and 35 are moved to turn on the microswitches 38*a*, 38*b*, 39*a* and 39*b* to send forward, backward and stop commands to the drive motors 25, 25*a*, 27 and 27*a*.

On the other hand, the threaded rod 30 connected to the output shaft of the first traverse drive motor 25 of the traverse rod 16 has its one end borne pivotally through the bearing 22 in the inner plate 20*a* of the side plate 20. A gear 40*a* is fixed on the inserted end of the threaded rod 30. This gear 40*a* is connected through three intermediate gears 42*a*, 42*b* and 42*c* to a gear 41 which in turn is fixed on the end portion of the traverse rod 16, as shown in FIG. 3. On the other hand, the threaded rod 31 connected to the output shaft of the first tilt drive motor 27 has its one end borne pivotally by a bearing 43*a* of a bearing plate 43 which is interposed between the first traverse drive motor 25 and the tilt controller 26. A gear 44*a* is fixed on the inserted end of the threaded rod 31. Below the first traverse drive motor 25 and the traverse controller 24, there is arranged a transmission rod 45 which is positioned in a side portion of the rod chamber 2 to have its two ends borne in the bearing plate 43 and the inner plate 20*a*. On the transmission rod 45 at the side of the bearing plate 43, there is fixed a gear 46 which is connected through two intermediate gears 47*a* and 47*b* to the gear 44*a* fixed on the threaded rod 31. On an end portion of the transmission rod 45 at the side of the inner plate 20*a*, on the other hand, there is fixed a gear 48 which is connected through one intermediate gear 50 to a gear 49 fixed on one end portion 12*a* of the tilt rod 12.

These gears 44*a*, 47*b*, 47*a*, 46, 48, 50 and 49 and the transmission rod 45 constitutes a first tilt rod transmission 44 altogether.

Moreover, the gears 40*a*, 42*c*, 42*b*, 42*a* and 41 constitute altogether a first traverse rod transmission 40.

At the other end side of the casing frame 1, on the other hand, there are accommodated in series in an upper portion of the rod chamber 2 the second traverse drive motor 25*a* for driving the other end 16*b* of the traverse rod 16 and a second tilt drive motor 27*a* for driving the other end 12*b* of the tilt rod 12. The other end 16*b* of the traverse rod 16 is connected to the second traverse drive motor 25*a* through a second traverse transmission 40*b* similar to the first one 40, whereas the second tilt drive motor 27*a* is connected to the other end 12*b* of the tilt rod 12 through both a second tilt transmission 44*b* similar to the first one 44 and a transmission rod 45*a*.

At one side of the lower portion of the casing frame 1, there is defined the rod chamber 2 to which is juxtaposed side by side a cord chamber 53 opened upward. A cover 55 is removably fitted in the upper opening of the cord chamber 53 through fitting grooves 54. Reference numeral 56 denotes reduction gear mechanisms which are attached to the drive motors 25, 25*a*, 27 and 27*a*, respectively.

When the first traverse drive motor 25 of the traverse rod 16 of the electric blind thus constructed is excited, its rotating force is transmitted sequentially through the threaded rod 30 and the gears 40*a*, 42*c*, 42*b*, 42*a* and 41 to one end 16*a* of the traverse rod 16 to rotate this rod 16. Simultaneously with this, the rotating force of the second traverse drive motor 25*a* is transmitted to the other end 16*b* of the traverse rod 16 through the second traverse transmission 40*b*. As this traverse rod 16 is rotated, the not-shown leading runner is traversed forward along the guide rails 3 through the corresponding rollers 5. This leading runner proceeds to a target position while sequentially pulling the succeeding runners 4 through the corresponding spacers 17. At that target position, the rotations of the traverse rod 16 are stopped. If the first tilt drive motor 27 is excited, on the other hand, its driving force is transmitted sequentially through the threaded rod 31, the gears 44*a*, 47*b*, 47*a* and 46, the transmission rod 45 and the gears 48, 50 and 49 to the end 12*a* of the tilt rod 12 to rotate the tilt rod 12. Simultaneously with this, the second tilt drive motor 27*a* is driven to transmit its driving force through the second tilt transmission 44*b* to the other end 12*b* of the tilt rod 12. As this tilt rod 12 is rotated, the worm shaft 9 is rotated through the worm gear 10 so that the slats 14 are tilted and opened to an arbitrary angle. If, at the retraction, the traverse rod 16 is rotated backward, the leading runner retracts to return to its initial position while sequentially pushing the succeeding runners 4. If the tilt rod 12 is then rotated backward, the slats 14 restore their initial angle. Moreover, the forward and backward rotations and the stops of the aforementioned drive motors 25, 25*a*, 27 and 27*a* are controlled by the traverse and tilt controllers 24 and 26.

Figure 7:
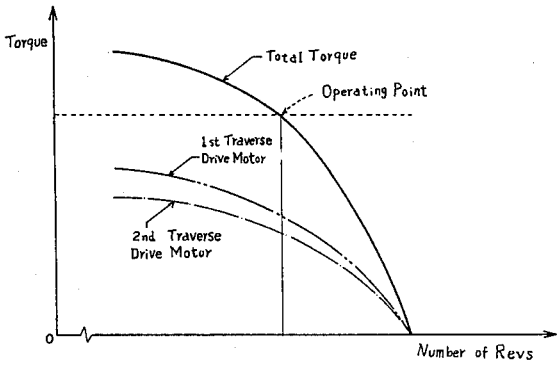
FIG. 7 is a graph presenting the characteristics of motors.

As described above, the driving force of the first traverse drive motor 25 is transmitted through the first traverse transmission 40 to the end 16*a* of the traverse rod 16 borne in the frame casing 1, and the driving force of the second traverse drive motor 25*a* is transmitted through the second traverse transmission 40*b* to the other end 16*b* of the traverse rod 16. As a result, the total of the torques of the motors 25 and 25*a* can be applied from the two ends 16*a* and 16*b* of the traverse rod 16, as shown in FIG. 7, to substantially eliminate any occurrence of torsion. Even if the slats 14 are heavy, moreover, the driving force can be increased to ensure the operations. Since the rotational driving force of the traverse rod 16 can be dispersed, furthermore, the first and second traverse drive motors 25 and 25*a* can be small-sized to reduce the overall size of their accommodating casing frame 1 thereby to present an excellently fine appearance when the electric blind is mounted.

Likewise, the driving force of the first tilt motor 27 can be transmitted through the first tilt transmission 44 to the end 12*a* of the tilt rod 12, and the driving force of the second tilt drive motor 27*a* can be transmitted through the second tilt transmission 44*b* to the other end 12*b* of the tilt rod 12. This makes it possible to substantially reduce any occurrence of torsion and to ensure the operations. Since the rotational driving force of the tilt rod 12 can be dispersed, the first and second tilt drive motors 27 and 27*a* can be small-sized to reduce the size of their accommodating casing frame 1.

Furthermore, the rotating force is transmitted between the first and second traverse drive motors 25 and 25*a* and the traverse rod 16 through the first and second traverse transmissions 40 and 40*b*. As a result, the first and second traverse drive motors 25 and 25*a* can be arranged in the upper portion of the casing frame 1 so that the traverse rod 16 is enabled to have substantially the same total length as that of the casing frame 1. Likewise, the tilt rod 12 and the casing frame 1 are enabled to have a substantially equal length by interposing the first and second tilt transmissions 44 and 44*b* between the first and second tilt drive motors 27 and 27*a* and the tilt rod 12.

Since, moreover, the transmission rod 45 of the first tilt transmission 44 is arranged clear of the first traverse drive motor 25 and the traverse controller 24, the first traverse drive motor 27 and the first tilt drive motor 25 can be compactly arranged in alignment with each other. Since the transmission rod 45*a* of the second tilt transmission 44*b* is likewise arranged clear of the second traverse drive motor 25*a* and so on, the second traverse drive motor 25*a* and the second tilt drive motor 27*a* can be compactly arranged in alignment with each other.

Figure 8:
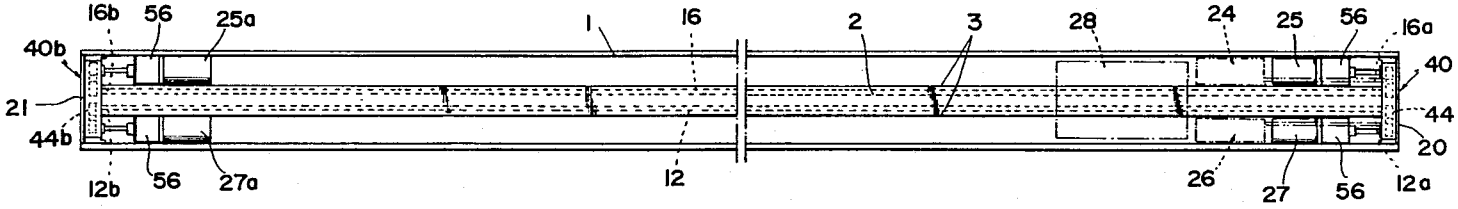
FIGS. 8, 9 and 10 are partially cut-away top plan views showing the overall structure of an actuator according to other embodiments of the present invention.
Figure 9:
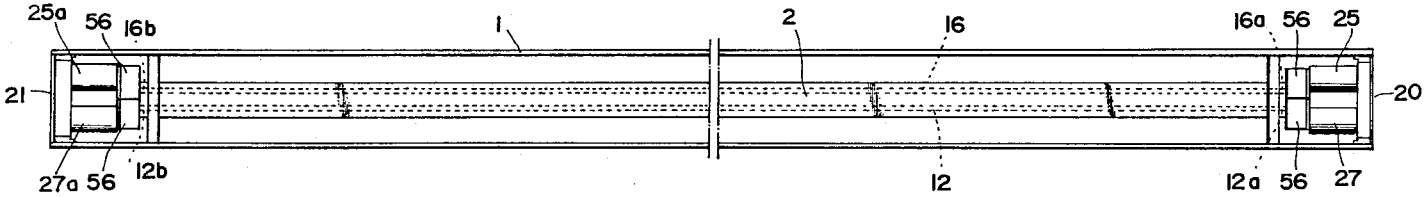
Figure 10:
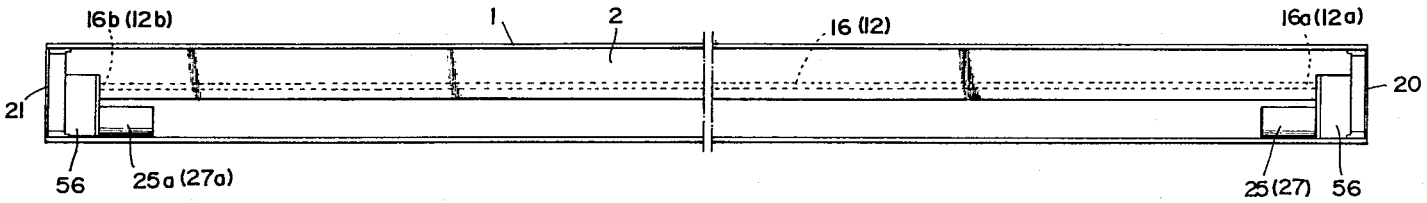
Figure 11:
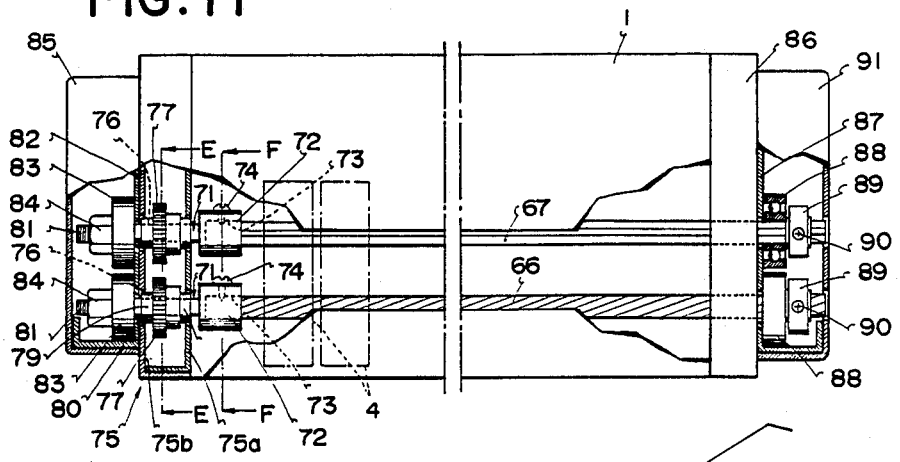
In FIGS. 11 to 17 showing traverse rod tensing mechanisms to be used with the actuator of the present invention.
Figure 12:
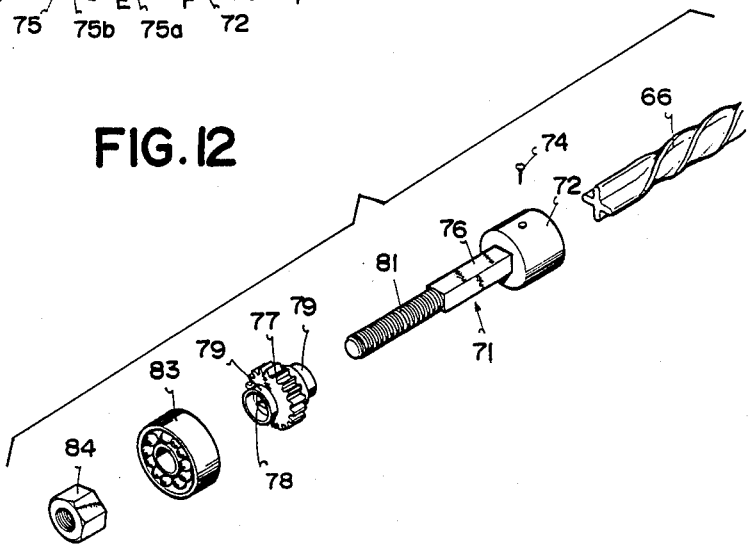
Figure 13:
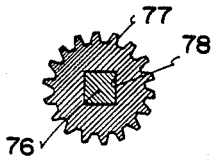
Figure 14:
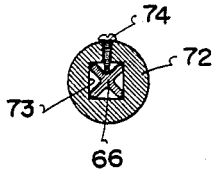
Figure 15:
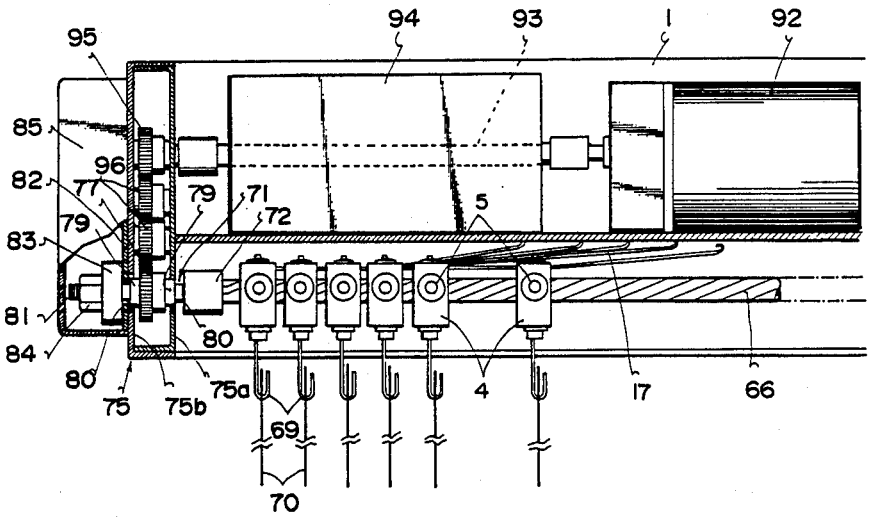

FIGS. 8 to 10 show other embodiments of the present invention, in which the same portions as those of the foregoing first embodiment are denoted at common reference numerals so that their detailed descriptions will be omitted.

In the embodiment of FIG. 8, the first traverse drive motor 25 is disposed at one side of one end of the casing frame 1, i.e., at the outside of the guide rails 3 whereas the first tilt drive motor 27 is disposed at the other side of the one end of the casing frame 1. Moreover, the second traverse drive motor 25*a* is disposed at one side of the other end of the casing frame 1 whereas the second tilt drive motor 27*a* is disposed at the other side of the other end of the casing frame 1. In other words, the first traverse drive motor 25 and the first tilt drive motor 27 are juxtaposed to each other at one end of the frame casing 1 whereas the second traverse drive motor 25*a* and the second tilt drive motor 27*a* are juxtaposed to each other at the other end of the frame casing 1. The driving forces of the first and second traverse drive motors 25 and 25a are transmitted through the first and second traverse transmissions 40 and 40b to the two ends 16a and 16b of the traverse rod 16. On the other hand, the driving forces of the first and second tilt drive motors 27 and 27a are transmitted through the first and second tilt transmissions 44 and 44b to the two ends 12a and 12b of the tilt rod 12.

Turning to FIG. 9, the tilt rod 12 and the traverse rod 16 are borne in juxtaposition in the frame casing 1. The first and second tilt drive motors 27 and 27a are disposed at the two ends 12a and 12b of and in alignment with the tilt rod 12. On the other hand, the first and second traverse drive motors 25 and 25a are disposed at the two ends 16a and 16b of and alignment with the traverse rod 16. Moreover, the tilt rod 12 is directly connected to the first and second tilt drive motors 27 and 27a through the corresponding one of the reduction gear mechanisms 56, a controller and so on. On the other hand, the traverse rod 16 is connected directly to the first and second traverse drive motors 25 and 25a through the corresponding one of the reduction gear mechanisms 56, a controller and so on.

The embodiments described above with reference to FIGS. 8 and 9 can be applied to the case in which the drive motors 25, 25a, 27 and 27a are relatively small-sized.

In the embodiment shown in FIG. 10, only one of the traverse rod 16 and the tilt rod 12 is borne in the casing frame 1 so that only the traverse drive motors 25 and 25a are provided in the case of provision of the traverse rod 16 only whereas the tilt drive motors 27 and 27a are provided in the case of provision of the tilt rod 12 only. Thus, the actuator of the present invention may be exemplified by providing only one of the tilt rod 12 and the traverse rod 16.

Incidentally, the present invention should not be limited to the foregoing embodiments. In the first embodiment, for example, the tilt drive motors may be disposed at the outer side whereas the traverse drive motors may be disposed at the inner side. Alternatively, the traverse rod may be driven by two drive motors whereas the tilt rod may be driven by one drive motor, or vice versa. The drive motors used in the embodiments are of AC type but may be modified into DC type.

Figure 16:
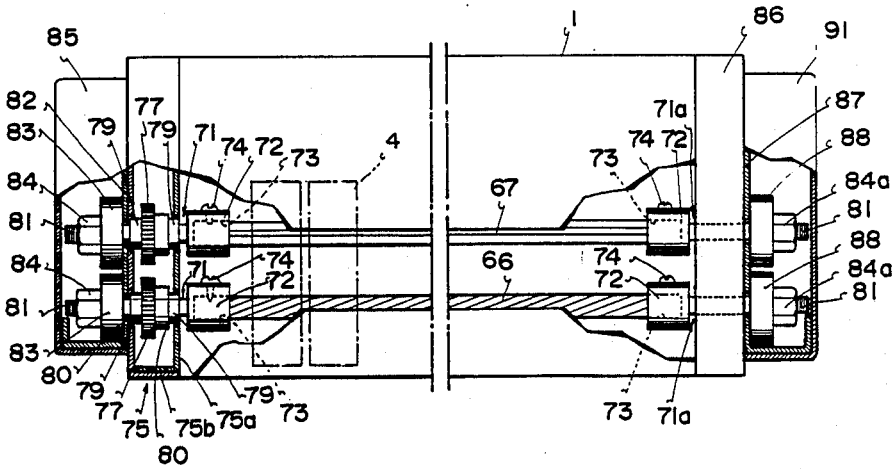
Figure 17:
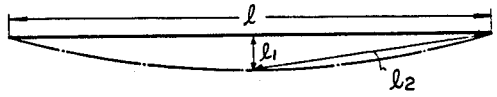

FIGS. 11 to 22 show tensing mechanisms for tensing the traverse rod. The amount of tension to be imparted to the traverse rod has to be 0.04 mm or more, for example, as given from the following equation in case a traverse rod having a length of $l=5500.00$ mm is subjected to a depression of $l_1=10$ mm, as shown in FIG. 17, because the length after depression of $l_2=2750.02$ mm:

$$2750.02\times 2=5500.04.$$

This implies that dispersions arise at a unit of 1/100 mm, thus raising a problem that fine adjustments of the tension are difficult. The description to be made in the following is directed to tensing mechanisms for the traverse rod of the electric blind or the like, which can easily adjust the tension to be applied to the traverse rod at an appropriate value.

FIGS. 11 to 15 show a tensing mechanism of one-side type, in which a traverse rod 66 and a tilt rod 67 have their respective one ends fitted in the fitting bores 73 of receiving heads 72 and 72 formed at the respective one ends of tensing threaded rods 71 and 71. Screws 74 are fastened to integrate together the traverse rod 66 and one tensing threaded rod 71, and the tilt rod 67 and the other tensing threaded rod 71. Incidentally, the receiving heads 72 and 72 may be biased toward the rods 66 and 67 by means of not-shown springs.

To one end of the casing frame 1, there is fastened by means of not-shown screws a gear accommodating side plate assembly 75 which is composed of an inner plate 75a and an outer plate 75b. The other ends of the tensing threaded rods 71 and 71 are inserted into the gear accommodating side plate assembly 75. These inside portions of the tensing threaded rods 71 and 71 inserted into the gear accommodating side plate assembly 75 are formed into a gear fitting square shanks 76 and 76 having square sections. Gears 77 and 77 have their square holes 78 and 78 fitted on those square shanks 76 of the tensing threaded rods 71 and 17 so that they can slide in the axial directions but engage in the circumferential directions with the tensing threaded rods 71 and 71. From the two ends of the gears 77 and 77, respectively, there are projected cylindrical flanges 79 and 79, one of which is pivotally fitted in a circular hole 80 formed in the inner plate 75a of the side plate assembly 75 and the other of which is pivotally fitted in a circular hole 80 formed in the outer plate 75b.

Tensing nuts 84 and 84 are fastened through bearing plates 82 and 82 and bearings 83 and 83 on threaded portions 81 and 81 of the tensing threaded rods 71 extending to the outside from the outer plate 75b. Denoted at numeral 85 is a cover for covering the bearings 83 and 83 and the nuts 84 and 84.

The other ends of the traverse rod 66 and the tilt rod 67 are inserted into a side plate 86 which is fastened to the other end of the casing frame 1 by means of not-shown screws. Stoppers 89 and 89 are fastened to the inserted ends of the rods 66 and 67 through a bearing plate 87 and bearings 88 and 88 by means of screws 90 and 90. Reference numeral 91 denotes a cover.

A traverse drive motor 92 is disposed in an upper portion of the casing frame 1. A threaded rod 93 is connected at its one end to the not-shown drive shaft of the traverse drive motor 92 and at its other end to the aforementioned gear 77 through a traverse controller 94, a gear 95 and intermediate gears 96 so that the driving force of the drive motor 92 is transmitted to the traverse rod 66 through the threaded rod 93 and the gears 95, 96 and 77. Incidentally, the driving force of the not-shown tilt drive motor is also transmitted to the tilt rod 67 by the structure similar to the aforementioned one.

If the tensing nuts 84 and 84 are fastened after the assembly of the electric blind thus constructed, their tensions are applied to the traverse rod 66 and the tilt rod 67 through the tensing threaded rods 71 and 71 because the traverse rods 66 and the tilt rod 67 have their other ends fixed by the rod stoppers 89 and 89. At this time, fine adjustments of the tensions are available depending upon the fastening extents of the nuts 84 and 84 so that appropriate tensions can be applied.

Thus, according to the present embodiment described above, the electric blind can be easily assembled including the tensing means without any requirement for the attachment and detachment of the tensing mechanism, and the tensions after the assembly can be adjusted. These adjustments can be finely performed merely by adjusting the fastening extents of the tensing nuts 84. Moreover, the traverse rod 66 and the tilt rod 67 can be pulled and straightened, even if they are slightly bent, so that they can be used as they are, because the tensions can be introduced by fastening the tensing nuts 84. Still moreover, even if the tensions of the tensing nuts 84 are applied to the tensing threaded rods 71, the gears can be prevented from coming out to cause troubles in the transmission of the driving forces, because the gears 77 are fitted on the square shanks 76 in a manner to freely slide in the axial directions. Furthermore, the traverse rod 66 can be prevented from any deflection by introducing the tension thereinto so that it can stand a slat load as high as about 70 Kg.

FIG. 16 shows a traverse rod tensing mechanism of two-side type, which has a similar structure to that of the aforementioned tensing mechanism of one-side type at one end of the traverse and tilt rods 66 and 67, and the description of the similar structure will be omitted. The other ends of the traverse rod 66 and the tilt rod 67 are fitted in the fitting bores 73 and 73 of the receiving heads 72 and 72 of tensing threaded rods 71*a* which have no gear fitting shank. Those other rod ends and the receiving heads 72 and 72 are fastened by means of the screws 74 and 74 to integrate the traverse rod 66 with one tensing threaded rod 71*a*, and the tilt rod 67 with the other tensing threaded rod 71*a*. Moreover, the threaded portions 81 and 81 of the tensing threaded rods 71*a* and 71*a* are inserted into the side plate 86, and tensing nuts 84*a* and 84*a* are fastened on the outside extensions of the threaded portions 81 and 81 through the bearing plate 87 and the bearings 88 and 88.

If the tensing nuts 84*a* and 84*a* are fastened on the two ends of the traverse rod 66 and the tilt rod 67 after the assembly of the electric blind thus constructed, tensions are applied from the two ends to the traverse rod 66 and the tilt rod 67 through the tensing threaded rods 71 and 71*a*. At this time, fine adjustment of the tensions can be achieved depending upon the fastening extents of the nuts 84 and 84*a* so that appropriate tensions can be applied.

Incidentally, the tensing mechanism according to the present invention should not be limited to the foregoing embodiments but can be modified in various fashions within the scope of the present invention. For example, the connecting structure for connecting the tensing threaded rod and the traverse rod and the fitting structure for fitting the gear on the tensing threaded rod may be appropriately selected within the scope of the present invention. The tensing means may be disposed at least at the side of the traverse rod. The associating structure for the gear and the tensing threaded rod may be disposed either at one of the two ends of the traverse rod or together with the support. On the other hand, the drive motors may be connected to the respective two ends of the traverse rod and the tilt rod.

FIGS. 18 to 22 show a rotation transmitting mechanism which is appropriate for the aforementioned tensing mechanisms, as will be described by denoting the common reference numerals at the portions identical to those of the foregoing embodiments.

Figure 18:
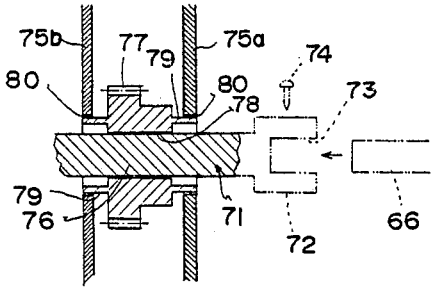
In FIGS. 18 to 22 showing a fitting structure to be used with the actuator of the present invention.
Figure 19:
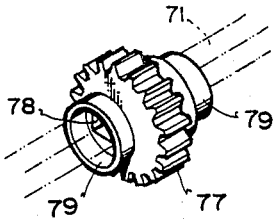

From the two ends of the gear 77, as shown in FIGS. 18 and 19, there are integrally projected the cylindrical flanges 79 and 79 which are fitted in the circular holes 80 and 80 formed in opposed positions in the outer and inner plates 75*b* and 75*a* of the gear accommodating side plate assembly 75 or the frame of the rotation transmitting mechanism. Thus, the gear 77 is pivotally fitted in the outer plate 75*b* and the inner plate 75*a*. The gear 77 is further formed at its center with the fitting hole 78 having a square section. The tensing rod 71, which is connected to the traverse rod 66 to form part of the rod 66, is formed with the gear fitting shank 76 having a square section and with the receiving head 72 at its axial end. Thus, the square shank 76 is inserted into the square hole 78 of the gear 77 so that the tensing rod 71 and the gear 77 are so fitted one in the other as to slide in the axial direction relative to each other but to engage with each other in the circumferential direction, thus constructing the aforementioned rotation transmitting mechanism.

If the tensing nuts 84 and 84 are fastened after the assembly of the electric blind thus constructed, the tensions are applied to the traverse rod 66 and the tilt rod 67 through the tensing rods 71 and 71 because the other ends of the rods 66 and 67 are fixed by the rod stoppers 89 and 89. At this time, fine adjustment of the tensions can be achieved depending upon the fastening extents of the nuts 84 and 84 so that appropriate tensions can be applied.

Thus, according to the aforementioned embodiment, the gear 77 is held in a pivotal state by the fitting engagement of the circular hole 80 and the flange 79, even if the tension of the tensing nut 84 is applied to the tensing rod 71. This is because the gear 77 and the tensing rod 71 are allowed to freely slide in the axial direction relative to each other so that no deviating force is applied to the gear 77. As a result, the tension can be adjusted after the assembly so that it can be maintained at an appropriate value.

Figure 20:
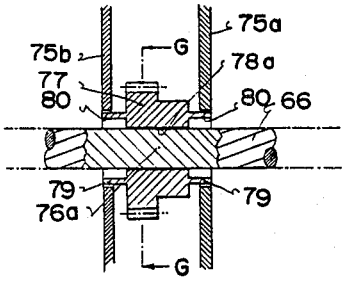
Figure 21:
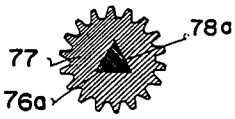
Figure 22:
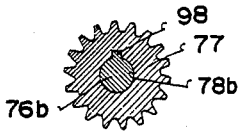

The description thus made in connection with the present embodiment is directed to the case in which the gear 77 is fitted on the tensing rod 71 forming part of the traverse rod 66. As shown in FIGS. 20 and 21, however, the traverse rod 66 may be formed at its end portion with a gear fitting shank 76*a* having a triangular section, which is inserted into a triangular hole 78*a* of the gear 77 of the rotation transmitting mechanism. In an alternative, as shown in FIG. 22, a gear fitting shank 76*b* may be formed with an axial key 98 whereas the gear 77 may be formed with a key way hole 78*b* shaped to correspond to the key shank 76*b* so that this key shank 76*b* may be inserted into the key way hole 78*b*.

Figure 23:
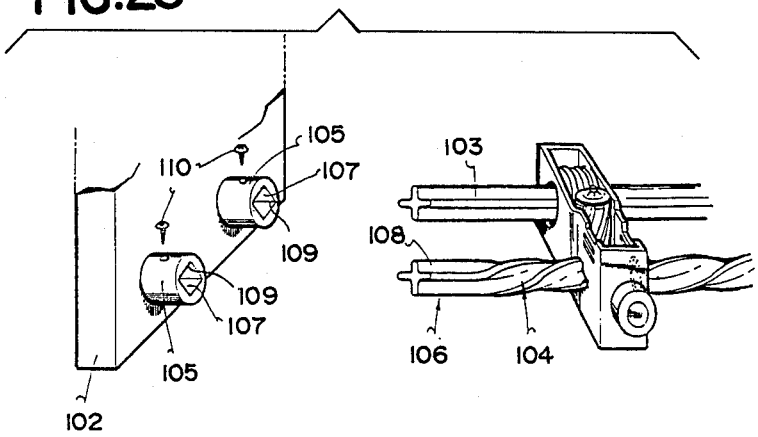
In FIGS. 23 to 25 showing a bearing unit to be used with the actuator of the present invention.
Figure 24:
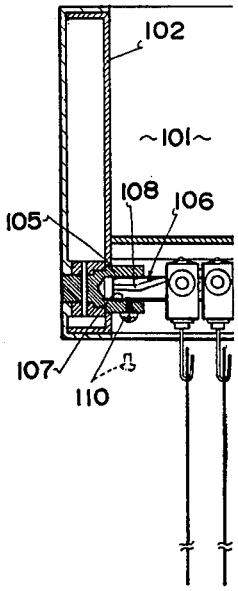
Figure 25:
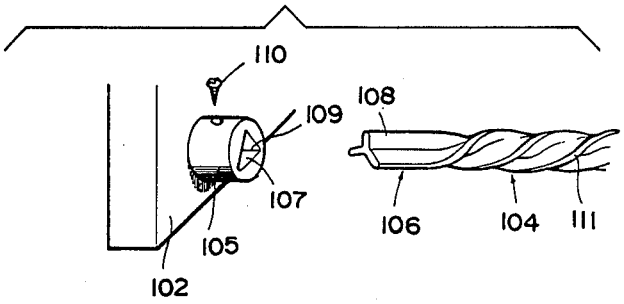

FIGS. 23 to 25 show a bearing unit which is appropriate for the traverse rod of the electric blind shown in FIGS. 1 to 10.

A casing frame 101 has its right and left open ends closed with side plates 102. In each of these side plates 102, there are pivotally fitted two bearings 105 in which are fitted the end portions of a tilt rod 103 and a traverse rod 104. This traverse rod 104 is formed at its two end portions with axial ridge portions 106, and the bearings 105 have their fitting bores 107 each formed into a square shape having such corners 109 as to receive the axial ridge portion 106 and fit their axial straight ridges 108 therein. Denoted at numeral 110 are screws for fastening the tilt rod 103 and the traverse rod 104 to prevent them from coming out from the bearings 105.

Thus, the traverse rod 104 of the bearing unit according to the present invention is formed at its two end portions with the axial ridge portions 106 having no helical thread, and the fitting bores 107 formed in the bearings 105 fitted pivotally in the side plate 102 are formed to have the square shape capable of fitting the individual straight ridges 108 of the axial ridge portions 106. As a result, in case the traverse rod 104 is rotated to open or close the electric blind, its rotating torque is transmitted from the corners 109 engaging with the four ridges 108 to the bearings 105. Since, in this way, the rotating torque is transmitted through the inner faces of the four corners 109, it is dispersed without any play so that the bearing 105 and the traverse rod 104 can be firmly connected to prevent the latter 104 from being broken. Incidentally, the screws 110 are driven into the traverse rod 104, but the driving force is transmitted mainly through the corners 109 and the straight ridges 108 so that the screws 110 are used to prevent the traverse rod 104 from coming out.

The embodiment detailed above can be modified within the scope of the present invention.

As shown in FIG. 25, for example, the traverse rod 104 may be formed with three axial straight ridges 108 at each extension of its helical threaded portion 111. In this modification, the fitting bore 107 of the bearing 105 is formed into a triangular shape having three corners 109 to engage with the respective ridges 108. On the other hand, the number of these axial straight ridges 108 may be set at various ones so that the shape of the fitting bore 107 of the bearing 105 may correspond to that number.

What is claimed is:

1. In an electric blind to be mounted on a mounting support face, comprising: a generally elongated casing frame having a pair of longitudinally extending guide rails; a relatively long rotating rod means borne rotatably in the longitudinal direction of said casing frame; a plurality of runners made rotatable to run one after another on said guide rails when said rotating rod means is driven; and a plurality of slats each suspended from the corresponding one of said runners, wherein said rotating rod means includes a relatively long traverse rod for traversing said slats through said runners when it is driven, and includes a relatively long tilt rod for tilting said slats through said runners when it is driven, an actuator for actuating said electric blind, comprising:

at least one pair of drive means disposed at two end portions of said casing frame for driving the two ends of said rotating rod means in a manner to eliminate any deformation of said rotating means, said drive means includes a pair of traverse drive motors for driving said traverse rod and includes a pair of tilt drive motors for driving said tilt rod;

drive transmission means for transmitting therethrough the driving forces of said drive means to said rotating rod means;

bearing means for bearing said rotating rod means; and tensing means for tensing said rotating rod means while the latter is rotating, said tensing means includes a tensing threaded rod borne in said bearing means and connected fixedly to at least one end of said rotating rod means; and a tensing nut for tensing said rotating rod means through said threaded rod when it is fastened to the threaded portion of said threaded rod.

2. An actuator according to claim 1, wherein said traverse drive motors and said tilt drive motors are arranged in alignment with each other at each of the end portions of said casing frame, and wherein said drive transmission means is arranged clear of one pair of said traverse drive motors and said tilt drive motors.

3. An actuator according to claim 1, wherein said traverse drive motors and said tilt drive motors are juxtaposed to each other at each of the end portions of said casing frame.

4. An actuator accoridng to claim 1, wherein said casing means includes side plates and said bearing means includes: a bearing borne rotatably in each of the side plates of said casing frame and having a fitting angular bore; and an axial ridge portion formed at each end of said rotating rod means and having a plurality of axial straight ridges fitted in the corners of said angular bore.

5. An actuator according to claim 1, wherein said rotating rod means has an axial ridge portion formed at one of its ends and having a plurality of axial straight ridges, and wherein said tensing threaded rod has a gear fitting shank at its center for fitting thereon one of a plurality of gears belonging to one of said drive transmission means, and a receiving head formed with a fitting angular bore for fitting the axial straight ridge in its corners.

6. An actuator according to claim 5, wherein said drive transmission means includes two frames and two trains of gears borne rotatably in said frames, respectively, one train meshing with said traverse drive motors and said traverse rod and the other meshing with said tilt drive motors and said tilt rod.

7. An actuator according to claim 5, further comprising rotation transmission means including: a fitting hole formed in each of said frames; and a pair of flanges formed at the two ends of one of the gears belonging to one of said two trains, one flange being fitted rotatably in said fitting hole and the other being so fitted on the gear fitting shank of said tensing threaded rod that said threaded rod is allowed to slide in the axial direction but engages in the circumferential direction.

8. An actuator according to claim 7, wherein the gear fitting shank of said tensing threaded rod has a square section so that said one gear has a square hole sized to fit said gear fitting shank therein.

9. An actuator according to claim 7, wherein the gear fitting shank of said tensing threaded rod has a triangular section so that said one gear has a triangular hole sized to fit said gear fitting shank therein.

10. An actuator according to claim 7, wherein the gear fitting shank of said tensing threaded rod has an axial key so that said one gear has a key way hole sized to fit said gear fitting shank therein.

11. An electric blind to be mounted on a mounting support face, comprising:

a gennerally elongated casing frame having a pair of longitudinally extending guide rails;

relatively long rotating rod means borne rotatably in the longitudinal direction of said casing frame;

a plurality of runners made rotatable to run one after another on said guide rails when said rotating rod means is driven;

a plurality of slats each suspended from the corresponding one of said runners;

said rotating rod means includes a relatively long traverse rod for traversing said slats through said runners whne it is driven, and includes a relatively long tilt rod for tilting said slats through said runners when it is driven;

an actuator for actuating said electric blind, including: at least one pair of drive means disposed at two end portions of said casing for driving the two ends of said rotating rod means in a manner to eliminate any deformation of said rotating rod means; said drive means includes a pair of traverse drive motors for driving said traverse rod and includes a pair of tilt drive motors for driving said tilt rod; drive transmission means for transmitting therethrough the driving forces of said drive means to said rotating rod means; and bearing means for bearing said rotating rod means;

tensing means for tensing said rotating rod means while the latter is rotating; said tensing means includes a tensing threaded rod borne in said bearing means and connected fixedly to at least one end of said rotating rod means; and a tensing nut for tensing said rotating rod means through said threaded rod when it is fastened to the threaded portion of said threaded rod.

12. An electric blind according ot claim 11, wherein said traverse drive motors and said tilt drive motors are arranged in alignment with each other at each of the end portions of said casing frame, and wherein said drive transmission means is arranged clear of one pair of said traverse drive motors and said tilt drive motors.

13. An electric blind according to claim 11, wherein sadi traverse drive motors and said tilt drive motors are juxtaposed to each other at each of the end portions of said casing frame.

14. An actuator according to claim 1, wherein said casing frame includes side plates and said bearing means includes: a bearing borne rotatably in each of the side plates of said casing frame and having a fitting angular bore; and an axial ridge portion formed at each end of said rotating rod means and having a plurality of axial straight ridges fitted in the corners of said angular bore.

15. An electric blind according to claim 11, wherein said rotating rod means has an axial ridge portion formed at one of its ends and having a plurality of axial straight ridges, and wherein said tensing threaded rod has a gear fitting shank at its center for fitting thereon one of a plurality of gears belonging to one of said drive transmission means, and a receiving head formed with a fitting angular bore for fitting the axial straight ridges in its corners.

16. An electric blind according to claim 15, wherein said drive transmission means includes two frames and two trains of gears borne rotatably in said frames, respectively, one train meshing with said traverse drive motors and said traverse rod and the other meshing with said tilt drive motors and said tilt rod.

17. An electric blind according to claim 15, further comprising rotation transmission means including: a fitting hole formed in each of said frames; and a pair of flanges formed at the two ends of one of the gears belonging to one of said two trains, one flange being fitted rotatably in said fitting hole and the other being so fitted on the gear fitting shank of said tensing threaded rod that said threaded rod is allowed to slide in the axial direction but engages in the circumferential direction.

* * * * *

UNITED STATES PATENT AND TRADEMARK OFFICE

CERTIFICATE OF CORRECTION

PATENT NO. : 4,773,464

DATED : September 27, 1988

INVENTOR(S) : Kobayashi

It is certified that error appears in the above-identified patent and that said Letters Patent is hereby corrected as shown below:

Column 2, line 36 after "drawings" insert a period --(.)--.

Column 2, line 50 delete "verticla" and insert --vertical--.

Column 7, line 14 after "alignment" and insert --in--.

Column 12, line 14 delete "ridge" and insert --ridges--.

Column 12, line 45 delete "gennerally" and insert --generally--.

Column 12, line 56 delete "whne" and insert --when--.

Column 13, line 12 delete "ot" and insert --to--.

Column 13, line 19 delete "sadi" and insert --said--.

Column 13, Claim 14, line 22, delete "1" and insert --11--.

Signed and Sealed this

Twenty-seventh Day of November, 1990

*Attest:*

HARRY F. MANBECK, JR.

*Attesting Officer*

*Commissioner of Patents and Trademarks*